US010975853B2

(12) United States Patent
Jang et al.

(10) Patent No.: US 10,975,853 B2
(45) Date of Patent: Apr. 13, 2021

(54) LINEAR COMPRESSOR WITH SOUND DAMPENING GASKETS

(71) Applicant: LG ELECTRONICS INC., Seoul (KR)

(72) Inventors: Jaeyong Jang, Seoul (KR); Changkyu Kim, Seoul (KR); Sanghyun Lim, Seoul (KR); Gyeoungjin Jeon, Seoul (KR); Dongkyun Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 423 days.

(21) Appl. No.: 15/581,155

(22) Filed: Apr. 28, 2017

(65) Prior Publication Data

US 2017/0321675 A1 Nov. 9, 2017

(30) Foreign Application Priority Data

May 3, 2016 (KR) ..... 10-2016-0054928

(51) Int. Cl.
*F04B 39/00* (2006.01)
*F04B 35/04* (2006.01)
(Continued)

(52) U.S. Cl.
CPC ..... *F04B 39/0055* (2013.01); *F04B 35/04* (2013.01); *F04B 35/045* (2013.01);
(Continued)

(58) Field of Classification Search
None
See application file for complete search history.

(56) References Cited

U.S. PATENT DOCUMENTS 4,121,125 A * 10/1978 Dolz ..... F04B 35/045 310/27
6,155,804 A * 12/2000 Hunsberger ..... F01C 21/10 181/202
(Continued)

FOREIGN PATENT DOCUMENTS

CN 1757917 4/2006
CN 101375060 2/2009
(Continued)

OTHER PUBLICATIONS

Chinese Office Action dated Jul. 27, 2018 (English Translation).
European Search Report dated Oct. 11, 2017.

*Primary Examiner* — Peter J Bertheaud
*Assistant Examiner* — Geoffrey S Lee
(74) *Attorney, Agent, or Firm* — KED & Associates LLP

(57) ABSTRACT

A linear compressor is provided that may include a cylinder which defines a compression space for a refrigerant and into which a piston that reciprocates in an axial direction may be inserted, a frame in which the cylinder may be accommodated, a discharge valve that selectively discharges the refrigerant compressed in the compression space for the refrigerant, a spring assembly coupled to the discharge valve, a discharge cover on which the spring assembly may be seated and having a discharge space through which the refrigerant discharged through the discharge valve may flow, and a first gasket seated inside of the discharge cover to support the spring assembly and attenuate vibration during an operation of the discharge valve.

21 Claims, 14 Drawing Sheets

(51) Int. Cl.
*F04B 39/12* (2006.01)
*F04B 39/10* (2006.01)
*F04B 37/18* (2006.01)

(52) U.S. Cl.
CPC ..... *F04B 37/18* (2013.01); *F04B 39/0027* (2013.01); *F04B 39/102* (2013.01); *F04B 39/121* (2013.01); *F04B 39/122* (2013.01)

(56) References Cited

U.S. PATENT DOCUMENTS

| | | | | |
|---|---|---|---|---|
| 8,556,599 | B2 * | 10/2013 | Lee | F04B 35/045 184/27.4 |
| 9,890,775 | B2 * | 2/2018 | Kim | F04B 39/102 |
| 2006/0076015 | A1 | 4/2006 | Kim | |
| 2016/0017883 | A1 * | 1/2016 | Noh | F04B 35/045 417/437 |

FOREIGN PATENT DOCUMENTS

| | | |
|---|---|---|
| CN | 105332899 | 2/2016 |
| CN | 107304759 | 10/2017 |
| KR | 10-0774057 | 11/2007 |
| KR | 10-2010-0112483 | 10/2010 |
| KR | 10-1307688 | 9/2013 |
| KR | 10-2016-0000324 | 1/2016 |
| KR | 10-2016-0010999 | 1/2016 |
| KR | 10-2016-0011008 | 1/2016 |
| WO | WO 2007/081192 | 7/2007 |

* cited by examiner

LINEAR COMPRESSOR WITH SOUND DAMPENING GASKETS

CROSS-REFERENCE TO RELATED APPLICATION(S)

The present application claims priority under 35 U.S.C. 119 and 35 U.S.C. 365 to Korean Patent Application No 10-2016-0054928, filed in Korea on May 3, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged is defined between an orbiting scroll and a fixed scroll to compress a refrigerant while the orbiting scroll rotates along the fixed scroll. In recent years, a linear compressor, which is directly connected to a drive motor, in which a piston linearly reciprocates to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

The present applicant has filed a patent (hereinafter, referred to as "Prior Art Document 1") and then has registered the patent with respect to the linear compressor, Korean Patent Registration No. 10-1307688, registered on Sep. 5, 2013 and entitled "LINEAR COMPRESSOR", which is hereby incorporated by reference. The linear compressor according to the Prior Art Document 1 includes a shell for accommodating a plurality of parts. A vertical height of the shell may be somewhat high as illustrated in FIG. 2 of the Prior Art Document 1. Also, an oil supply assembly for supplying oil between a cylinder and a piston may be disposed within the shell.

When the linear compressor is provided in a refrigerator, the linear compressor may be disposed in a machine room provided at a rear side of the refrigerator. In recent years, a major concern of a customer is increasing an inner storage space of the refrigerator. To increase the inner storage space of the refrigerator, it may be necessary to reduce a volume of the machine room. Also, to reduce the volume of the machine room, it may be important to reduce a size of the linear compressor.

However, as the linear compressor disclosed in the Prior Art Document 1 has a relatively large volume, it is necessary to increase a volume of a machine room into which the linear compressor is accommodated. Thus, the linear compressor having a structure disclosed in the Prior Art Document 1 is not adequate for the refrigerator for increasing the inner storage space thereof.

To reduce the size of the linear compressor, it may be necessary to reduce a size of a main part or component of the compressor. In this case, performance of the compressor may deteriorate. To compensate for the deteriorated performance of the compressor, the compressor drive frequency may be increased. However, the more the drive frequency of the compressor is increased, the more a friction force due to oil circulating into the compressor increases, deteriorating performance of the compressor.

To solve these limitations, the present applicant has filed a patent application (hereinafter, referred to as "Prior Art Document 2"), Korean Patent Publication No. 10-2016-0000324 published on Jan. 4, 2016, and entitled "LINEAR COMPRESSOR", which is hereby incorporated by reference. In the linear compressor of the Prior Art Document 2, a gas bearing technology in which a refrigerant gas is supplied in a space between a cylinder and a piston to perform a bearing function is disclosed. The refrigerant gas flows to an outer circumferential surface of the piston through a nozzle of the cylinder to act as a bearing in the reciprocating piston.

In the linear compressor of the Prior Art Document 2, a discharge cover is coupled to an end of a frame and a discharge valve is disposed between the discharge cover and the frame. The discharge valve is supported by a valve spring so that the discharge valve is opened and closed.

However, in such a structure, vibration may be generated in the frame and the discharge valve by elastic deformation of the valve spring and pulsation of the discharged refrigerant gas. As the vibration of the discharge valve is transferred to the shell through a support device that supports the discharge cover, the vibration and noise may be generated in the entire compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
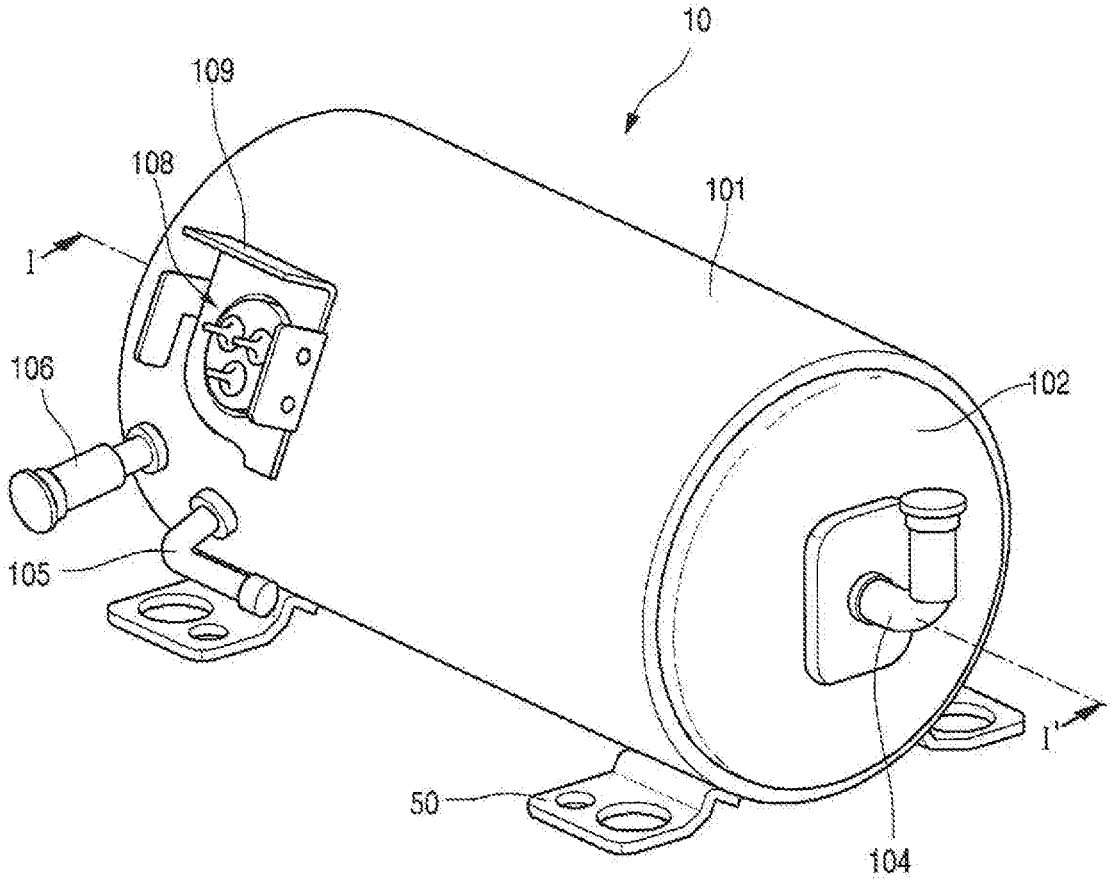
FIG. 1 is a perspective view illustrating an outer appearance of a linear compressor according to an embodiment.
Figure 2:
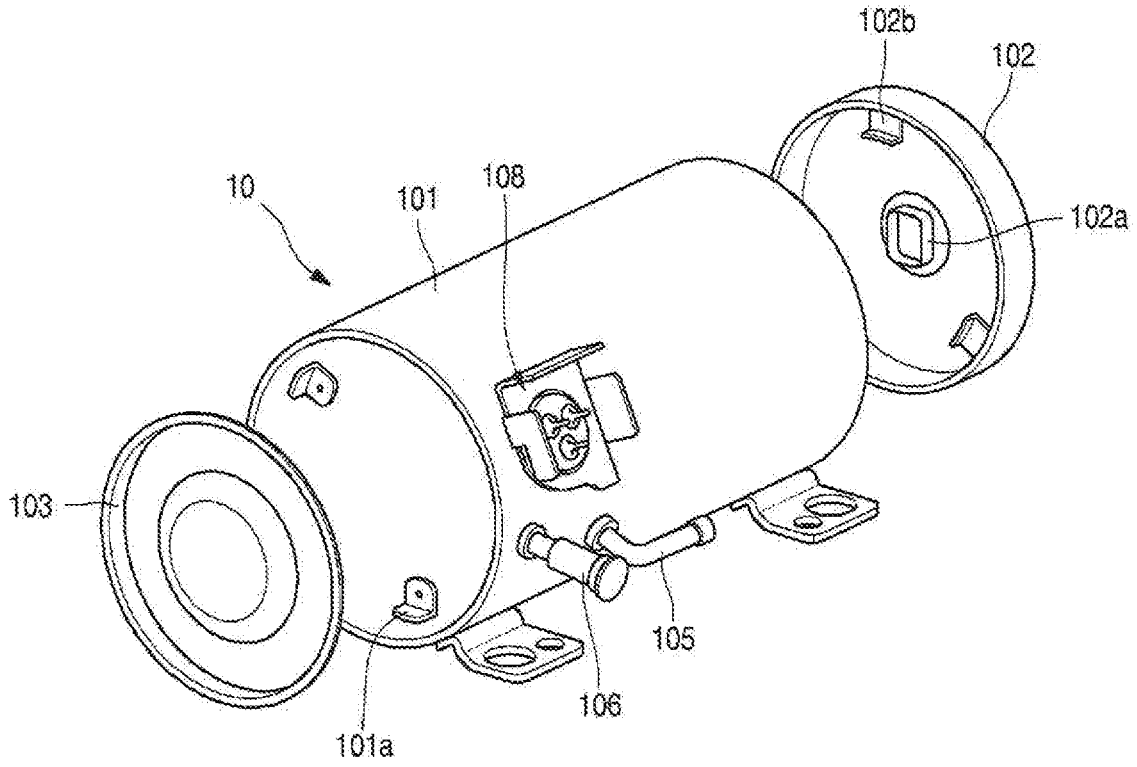
FIG. 2 is an exploded perspective view illustrating a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in en axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed adjacent to an inner circumferential surface of the shell 101, which corresponds to a point to which the process pipe 106 may be coupled. That is, at least a portion of the second shell cover 103 may act as a flow resistance to the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant be vaporized. Also, in this process, oil contained in the refrigerant may be separated. Thus, the refrigerant from which the oil is separated may be introduced into a piston 130 to improve compression performance of the refrigerant. The oil may be understood as a working oil existing in a cooling system.

A cover support part or support 102*a* may be disposed or provided on an inner surface of the first shell cover 102. A second support device or support 185, which will be described hereinafter, may be coupled to the cover support part 102*a*. The cover support part 102*a* and the second support device 185 may be understood as devices that support a main body of the linear compressor 10. The main body of the compressor may represent a part or portion provided in the shell 101. For example, the main body may include a drive part or drive that reciprocates forward and backward and a support part or support that supports the drive part. The drive part may include parts or components, such as the piston 130, a magnet frame 138, a permanent magnet 146, a support 137, and a suction muffler 150. Also, the support part may include parts or components such as resonant springs 176*a* and 176*b*, a rear cover 170, a stator cover 149, a first support device or support 165, and a second support device or support 185.

A stopper 102*b* may be disposed or provided on the inner surface of the first shell cover 102. The stopper 102*b* may be understood as a component that prevents the main body of the compressor, particularly, the motor assembly 140 from being bumped by the shell 101 and thus damaged due to vibration or an impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part or portion 101*a* may be disposed or provided on the inner surface of the shell 101. For example, the spring coupling part 101*a* may be disposed at a position n which is adjacent to the second shell cover 103. The spring coupling part 101*a* may be coupled to a first support spring 66 of the first support device 165, which will be described hereinafter. As the spring coupling part 101*a* and the first support device 165 are coupled to each other, the main body of the compressor may be stably supported inside of the shell 101.

Figure 3:
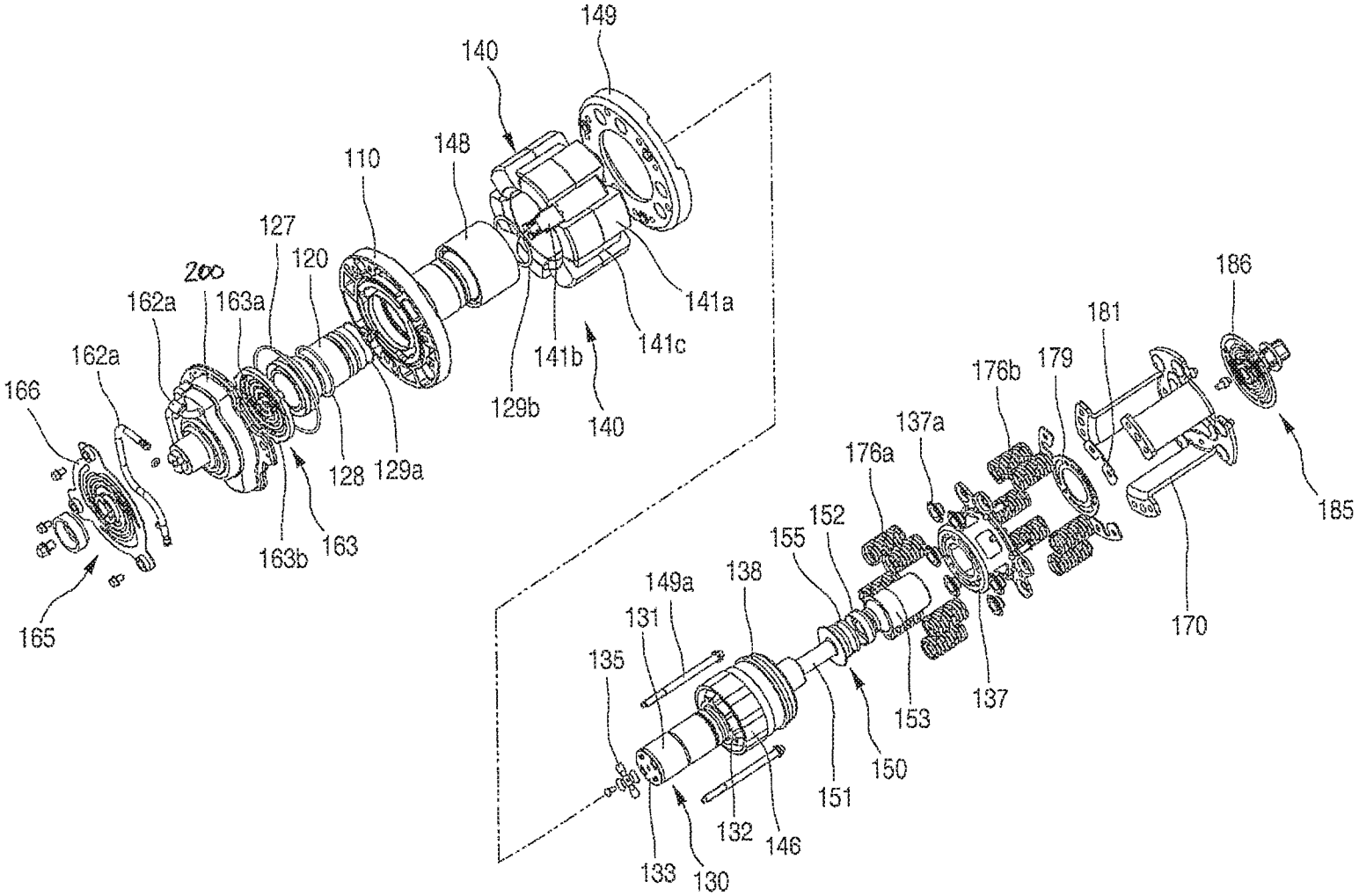
FIG. 3 is an exploded perspective view illustrating internal parts or components of the linear compressor according to an embodiment.
Figure 4:
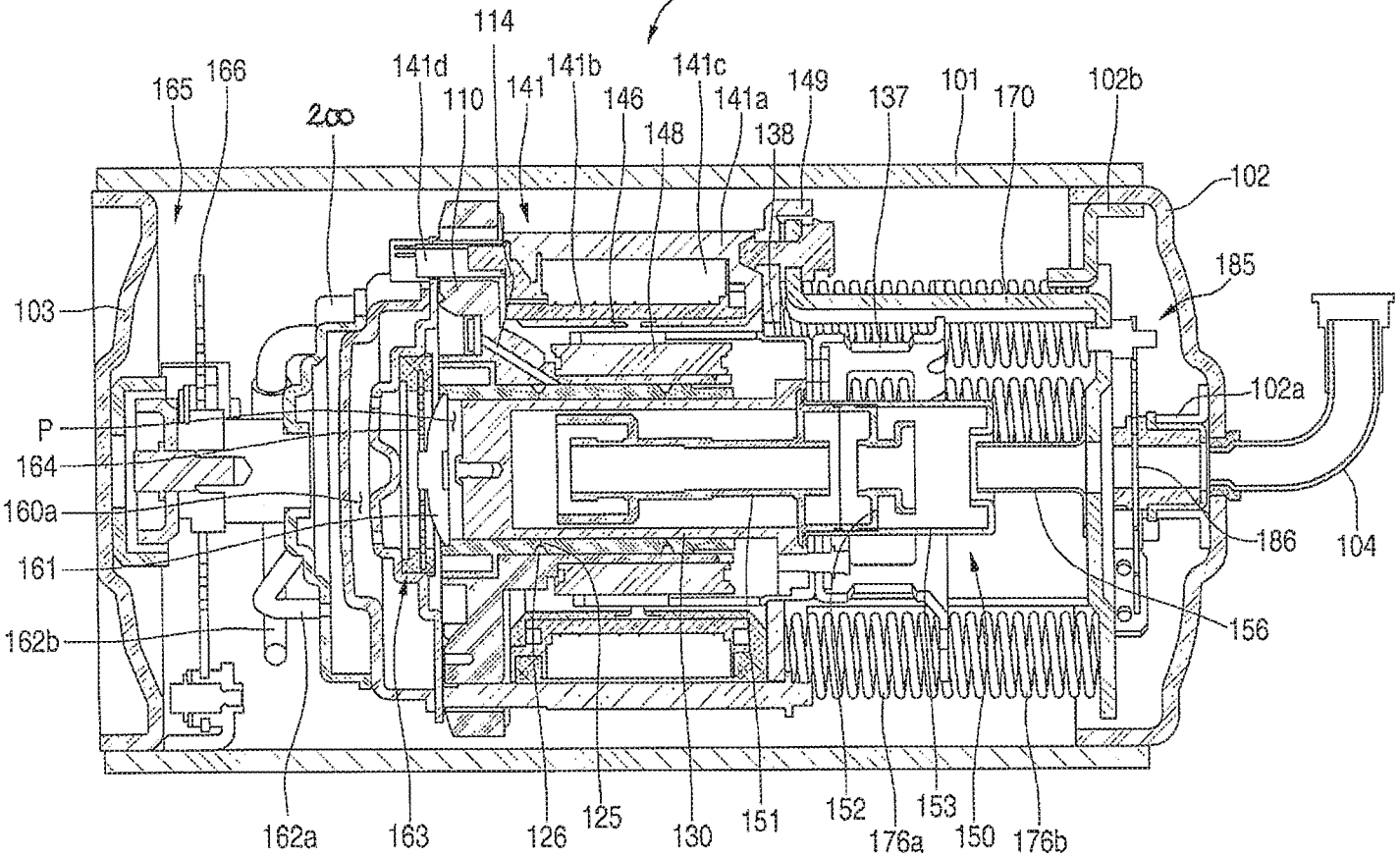
FIG. 4 is a cross-sectional view taken along line I-I' of FIG. 1.

FIG. 3 is an exploded perspective view illustrating internal parts or components of the linear compressor according to an embodiment. FIG. 4 is a cross-sectional view, taken along line I-I' of FIG. 1.

Referring to FIGS. 3 and 4, the linear compressor 10 according to an embodiment may include a cylinder 120 provided in the shell 101, the piston 130, which linearly reciprocates within the cylinder 120, and the motor assembly 140, which functions as a linear motor to apply drive force to the piston 130. When the motor assembly 140 is driven, the piston 130 may linearly reciprocate in the axial direction.

The linear compressor 10 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, the flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand the "radial direction" may be understood as a direction which is perpendicular to the direction in which the piston 130 reciprocates, that is, a vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge covet 200 that defines a discharge space for the refrigerant discharged from the compression space P and a discharge valve assembly 161 and 163 coupled to the discharge cover 200 to selectively discharge the refrigerant compressed in the compression space P may be provided at a front side of the compression space P. The discharge cover 200 may include a plurality of covers (see reference numeral 210, 230, and 250 of FIG. 6). The discharge space may have a plurality of space pads or spaces defined by the plurality of covers 210, 230, and 250. The plurality of space parts may be disposed or provided in a front and rear direction to communicate with each other. This will be described hereinafter.

The discharge valve assembly 161 and 163 may include a discharge valve 161 which may be opened when the pressure of the compression space P is above a discharge pressure to introduce the refrigerant into the discharge space and a spring assembly 163 disposed or provided between the discharge valve 161 and the discharge cover 200 to provide elastic force in the axial direction. The spring assembly 163 may include a valve spring 163*a* and a spring support part or support 163*b* that supports the valve spring 163*a* to the discharge cover 200. For example, the valve spring 163*a* may include a plate spring.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on or at one side of the compression space P and the discharge valve 161 may be disposed on or at the other side of the compression space P, that is, an opposite side of the suction valve 135.

While the piston 130 linearly reciprocates within the cylinder 120 when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P Into the discharge space of the discharge cover 200. When the discharge of the refrigerant is completed, the valve spring 163*a* may provide restoring force to the discharge valve 161 to close the discharge valve 161.

The linear compressor 10 may further include a cover pipe 162*a* coupled to the discharge cover 200 to discharge the refrigerant flowing through the discharge space of the discharge cover 200. For example, the cover pipe 162*a* may be made of a metal material.

Also, the linear compressor 10 may further include a loop pipe 162*b* coupled to the cover pipe 162*a* to transfer the refrigerant flowing through the cover pipe 162*a* to the discharge pipe 105. The loop pipe 162*b* may have one or a first side or end coupled to the cover pipe 162*a* and the other or a second side or end coupled to the discharge pipe 105.

A cover coupling part or portion 162*c* coupled to the cover pipe 162*a* may be disposed or provided on the one side portion of the loop pipe 162*b*, and a discharge coupling part or portion 162*d* coupled to the discharge pipe 105 may be disposed or provided on the other side portion of the loop pipe 162*b*. The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 may further include a frame 110. The frame 110 is understood as a component for fixing the cylinder 120. For example, the cylinder 120 may be press-fitted into the frame 110.

The frame 110 may be disposed or provided to surround the cylinder 120. That is, the cylinder 120 may be disposed or provided to be accommodated into the frame 110. Also, the discharge cover 200 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and the permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange part 132 to extend in an outer radial direction and then be bent forward. The permanent magnet 146 may be installed or provided on a front portion of the magnet frame 138. When the permanent magnet 146 reciprocates the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed or provided on one or a first side of the outer stator 141. That is, the outer stator 141 may have one or a first side supported by the frame 110 and the other or a second side supported by the stator cover 149.

The linear compressor 10 may further include a cover coupling member 149*a* for coupling the stator cover 149 to the frame 110. The cover coupling member 149*a* may pass through the stator cover 149 to extend forward to the frame 110 and then be coupled to a first coupling hole (not shown) of the frame 110.

The inner stator 148 may be fixed to a circumference of the frame 110. Also, in the inner stator 148, the plurality of laminations may be laminated in the circumferential direction outside of the frame 110.

The linear compressor 10 may further include a support 137 that supports the piston 130. The support 137 may be coupled to a rear portion of the piston 130, and the muffler 150 may be disposed or provided to pass through the inside of the support 137. The piston flange part 132 the magnet frame 138, and the support 137 may be coupled to each other using a coupling member.

A balance weight 179 may be coupled to the support 137. A weight of the balance weight 179 may be determined based on a drive frequency range of the compressor body.

The linear compressor 10 may further include a rear cover 170 coupled to the stator cover 149 to extend backward and supported by the second support device 185. The rear cover 170 may include three support legs, and the three support legs may be coupled to a rear surface of the stator cover 149. A spacer 181 may be disposed or provided between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 may further include an inflow guide part or guide 156 coupled to the rear cover 170 to guide an inflow of the refrigerant into the muffler 150. At least a portion of the inflow guide part 156 may be inserted into the suction muffler 150.

The linear compressor 10 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the rear cover 170. The drive part that reciprocates within the linear compressor 10 may be stably moved by the action of the plurality of resonant springs 176*a* and 176*b* to reduce vibration or noise due to the movement of the drive part. The support 137 may include a first spring support part or support 137*a* coupled to the first resonant spring 176*a*.

The linear compressor 10 may include a plurality of sealing members or seals 127, 128, 129*a*, and 129*b* that increases a coupling force between the frame 110 and the peripheral parts around the frame 110. The plurality of sealing members 127, 128, 129*a*, and 129*b* may include a first sealing member 127 disposed or provided at a portion at which the frame 110 and the discharge cover 200 are coupled to each other. The first sealing member 127 may be disposed or provided on or in a second installation groove (not shown) of the frame 110.

The plurality of sealing members 127, 128, 129*a*, and 129*b* may further include a second sealing member 128 disposed or provided at a portion at which the frame 110 and the cylinder 120 are coupled to each other. The second sealing member 128 may be disposed on or in a first installation groove (not shown) of the frame 110.

The plurality of sealing members 127, 128, 129*a*, and 129*b* may further include a third sealing member 129*a* disposed or provided between the cylinder 120 and the frame 110. The third sealing member 129*a* may be disposed or provided on or in a cylinder groove defined in the rear portion of the cylinder 120.

The plurality of sealing members 127, 128, 129*a*, and 129*b* may further include a fourth sealing member 129*b* disposed or provided at a portion at which the frame 110 and the inner stator 148 are coupled to each other. The fourth sealing member 129*b* may be disposed or provided on or in a third installation groove (not shown) of the frame 110.

Each of the first to fourth sealing members 127, 128, 129*a*, and 129*b* may have a ring shape.

The linear compressor 10 may further include a first support device or support 165 coupled to a support coupling part or portion of the discharge cover 200 to support one side of the main body of the compressor 10. The first support device 165 may be disposed or provided adjacent to the second shell cover 103 to elastically support the main body of the compressor 10. The first support device 165 may include a first support spring 166. The first support spring 166 may be coupled to the spring coupling part 101*a*.

The linear compressor 10 further includes a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

Figure 5:
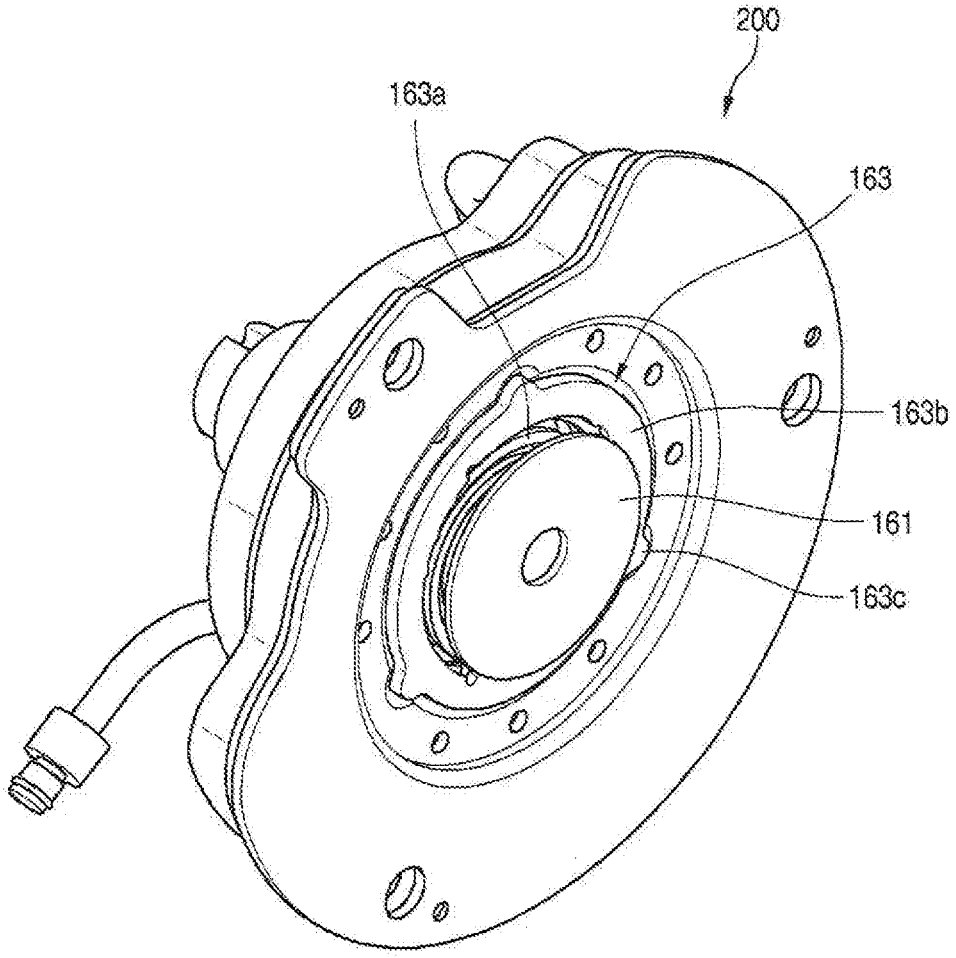
FIG. 5 is a perspective view illustrating a state in which a discharge cover and a discharge valve assembly are coupled to each other according to an embodiment.
Figure 6:
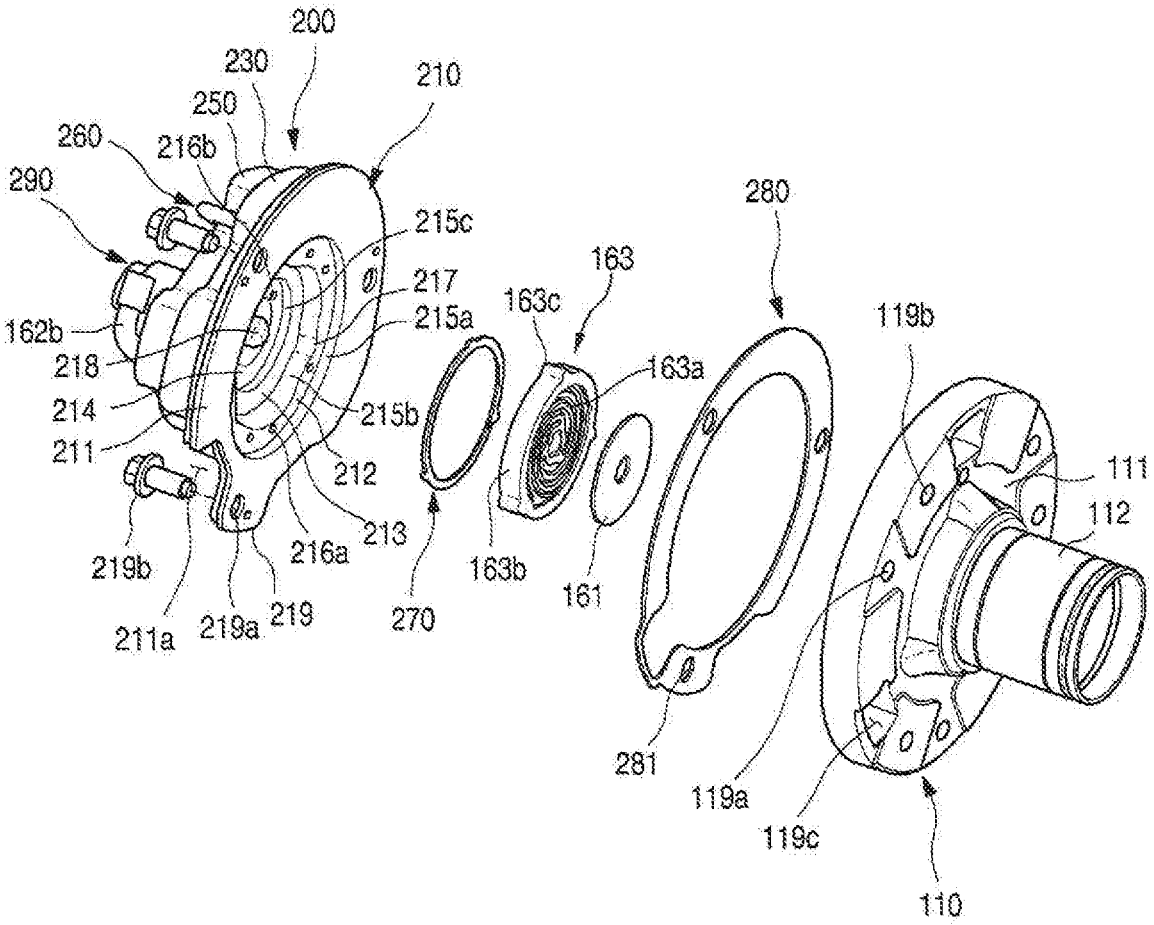
FIG. 6 is an exploded perspective view illustrating a state in which a discharge cover, a discharge valve, a gasket, and a frame are coupled to each other according to an embodiment.
Figure 7:
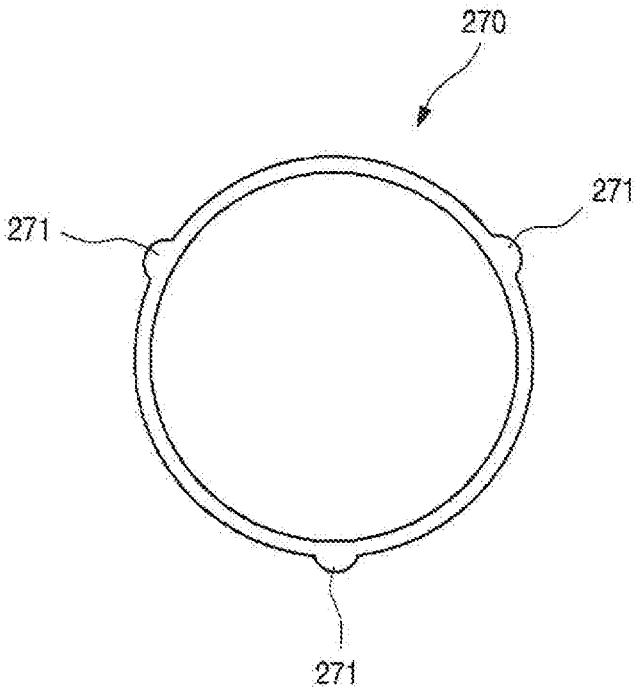
FIG. 7 is a plan view of a first gasket according to an embodiment.
Figure 8:
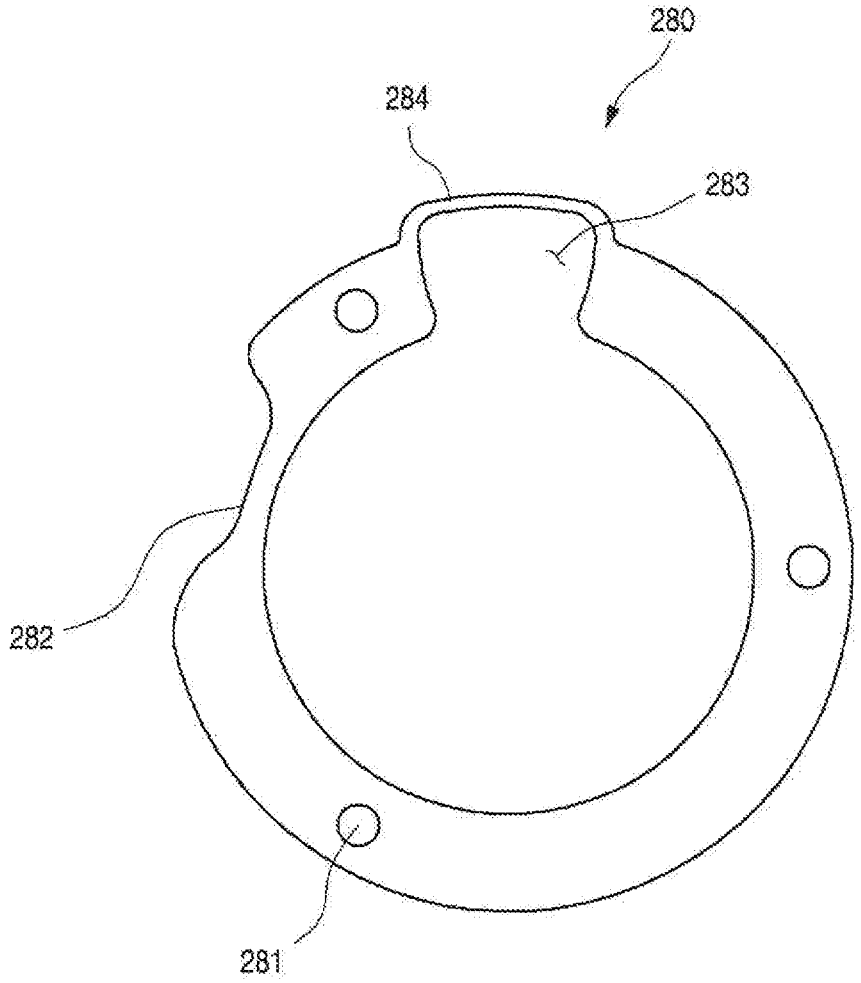
FIG. 8 is a plan view of a second gasket according to an embodiment.

FIG. 5 is a perspective view illustrating a state in which a discharge cover and a discharge valve assembly are coupled to each other according to an embodiment. FIG. 6 is an exploded perspective view illustrating a state in which a discharge cover, a discharge valve, a gasket, and a frame are coupled to each other according to an embodiment. FIG. 7 is a plan view of a first gasket according to an embodiment. FIG. 8 is a plan view of a second gasket according to an embodiment.

Referring to FIGS. 5 to 8, the linear compressor 10 according to an embodiment may include discharge valve assembly 161 and 163 and a discharge cover 200 coupled to the discharge valve assembly 161 and 163 to define a discharge space of the refrigerant discharged from a compression space P of the cylinder 120. For example, the discharge valve assembly 161 and 163 may be press-fitted and coupled to the discharge cover 200.

A first gasket 270 may be disposed or provided between the discharge valve assembly 161 and 163 and the discharge cover 200, and a second gasket 280 may be disposed or provided between the discharge cover 200 and the frame 110, so as to reduce vibration and noise generated in the discharge cover 200.

The discharge valve assembly 161 and 163 may include a discharge valve 161 installed or provided on or at a front end of the cylinder 120 to selectively open the compression space P and a spring assembly 163 coupled to a front side of the discharge valve 161. When the discharge valve 161 is closely attached to the front end of the cylinder 161, the compression space P may be closed. When the discharge valve 161 moves forward and then is spaced apart from the cylinder 161, the refrigerant compressed in the compression space P may be discharged.

The spring assembly 163 may include a valve spring 163*a* coupled to the discharge valve 161. For example, the valve spring 163*a* may include a plate spring having a plurality of cutoff grooves. A coupling hole, to which the discharge valve 161 may be coupled, may be defined in an approximately central portion of the valve spring 163*a*.

The spring assembly 163 may include the spring support part 163*b* coupled to the valve spring 163*a*. The spring support part 163*b* may be understood as a component coupled to the discharge cover 200 to support the valve spring 163*a* to the discharge cover 200. For example, the spring support part 163*b* may be press-fitted and coupled to the discharge cover 200. Also, the spring support part 163*b* may be integrally injection-molded to the valve spring 163*a* through an insert-injection-molding process, for example.

Due to the injection molding of the spring support part 163*b*, the spring assembly 163 may stably support the discharge valve 161 inside of the discharge cover 200 in a high temperature environment of about 150° C. or higher. Also, as the spring assembly 163 is press-fitted and fixed to the inside of the discharge cover 200, it is possible to prevent the spring assembly 163 from moving.

The discharge cover 200 may further include a first gasket 270 installed or provided on or at a front side of the spring assembly 163. The first gasket 270 may allow the spring assembly 163 to be closely attached to the discharge cover 200 to prevent the refrigerant from leaking through a space between the spring assembly 163 and the discharge cover 200.

The spring support part 163*b* may include a first protrusion 163*c* that prevents the discharge valve 161 and the spring assembly 163 from rotating. A plurality of the first protrusion 163*c* may be provided on an outer circumferential surface of the spring support part 163*b*.

For example, three first protrusions 163*c* may be provided at equal intervals along a circumference of the spring support part 163*b*. That is, the first protrusions 163*c* may be respectively formed at positions rotated 120° with respect to a center of the spring assembly 163. Therefore, the spring assembly 163 may maintain balance in the whole weight and structure and may prevent the occurrence of local inclination and vibration.

The first gasket 270 may be closely attached to the spring assembly 163 to reduce vibration noise generated during an opening and closing operation of the discharge valve 161. The first gasket 270 may be formed to have a sheet shape having a certain thickness and may be made of an asbestos-free material. For example, the gasket may be made of one of MP-15, CMP4000, or NI-2085, which are brand names.

The first gasket 270 may be seated on an inner surface of the discharge cover 200 and may be formed to have a diameter corresponding to the spring assembly 163. Also, the first gasket 270 may be formed to have a shape corresponding to a cross-sectional shape of the spring support part 163*b*. Therefore, when the first gasket 270 and the spring assembly 163 are sequentially mounted on the discharge cover 200, the first gasket 270 may stably support the spring assembly 163.

A plurality of second protrusions 271 may be formed to protrude outward from the first gasket 270. Three second protrusions 271 may be provided at equal intervals along a circumference of the first gasket 270 at the same positions as the first protrusions 163*c*. Therefore, the first gasket 270 also may maintain balance in the whole weight and structure and may prevent occurrence of local inclination and vibration.

The discharge cover 200 may further include a recess part or recess 217 coupled to an outer circumferential surface of the spring assembly 163 or an outer circumferential surface of the first gasket 270. The first protrusion 163*c* and the second protrusion 271 may be accommodated in the recess part 217. The recess part 217 may be defined in the first cover 210 and a plurality of the recess part 217 may be provided to correspond to the plurality of protrusions 163*c* and 164*a*.

A process of coupling the spring assembly 163 to the discharge cover 200 be described hereinafter. The first gasket 270 may be seated on a third part or portion 213 of the discharge cover 200. The second protrusion 271 of the first gasket 270 may be inserted into the recess part 217.

Also, the spring assembly 163 may be press-fitted into the discharge cover 200. A front surface of the spring assembly 163 may be coupled to the third part 213 while pressing the first gasket 270, and the first protrusion 163*c* may be disposed or provided in the recess part 217.

As the spring assembly 163 may be press-fitted into the discharge cover 200, the spring assembly 163 and the discharge valve 161 may be stably supported by the discharge cover 200. Also, as the first and second protrusions 163*c* and 271 may be coupled to the recess part 217, rotation of the spring assembly 163 and the discharge valve 161 may be prevented. Due to the coupling between the recess part 217 and the protrusion 271, the spring assembly 163 and the first gasket 270 may not be rotated and may maintain a state of being fixedly mounted on an inner side of the discharge cover 200. Therefore, vibration caused by rotation and noise caused by spacing may be prevented.

The discharge cover 200 may include a first cover 210 that defines a first space part 210*a* in which the discharge valve 161 and the spring assembly 163 may be disposed or provided. The first cover 210 may be stepped forward.

The first cover 210 may include a first part or portion 211 that defines a rear surface of the first cover 210 and provides a coupling surface to which the frame 110 may be coupled and a first stepped part or step 215*a* that extends forward from the first part 211. The first cover 210 may have a shape which is recessed forward from the first part 211 by the first stepped part 215*a*. The first cover 210 may further include a second part or portion 212 that extends by a first preset or predetermined length inward from the first stepped part 215*a* in the radial direction.

The first cover 210 may further include a second stepped part or step 215*b* that extends forward from the second part 212. The first cover 210 may have a shape which is recessed forward from the second part 212 by the second stepped part 215*b*. The recess part 217 may be defined in an outer circumferential surface of the second stepped part 215*b*.

The first cover 210 may further include a third part or portion 213 that extends by a second preset or predetermined length inward from the second stepped part 215*b* in the radial direction. The third part 213 may have a seating surface on which the spring assembly 163 may be seated.

The first gasket 270 may be disposed or provided on the third part 213, and the spring assembly 163 may be coupled to a rear side of the third part 213. Thus, the third part 213 may be coupled to a front surface of the spring assembly 163. Also, the outer circumferential surface of the spring assembly 163 may be press-fitted into the second stepped part 215*b*.

The first cover 210 may further include a third stepped part or step 215*c* that extends forward from the third part 213. The first cover 210 may have a shape which is recessed forward from the third part 213 by the third stepped part 215*c*. The first cover 210 may further include a fourth part or portion 214 that extends inward from the third stepped part 215 in the radial direction.

A stopper 218 that protrudes backward may be disposed or provided in an approximately central portion of the fourth part 214. When the linear compressor 10 abnormally operates, particularly, when an opened degree of the discharge valve 161 is greater than a preset or predetermined level, the stopper 218 may protect the discharge valve 161 or the valve spring 163*a*.

The abnormal operation may be understood as a momentary abnormal behavior of the discharge valve 161 due to a variation in flow rate or pressure within the compressor. The stopper 218 may interfere with the discharge valve 161 or the valve spring 163*a* to prevent the discharge valve 161 or the valve spring 163*a* from further moving forward.

Discharge holes 216*a* and 216*b*, through which the refrigerant flowing through the first space part 210*a* may be transferred to the second cover 230, may be defined in the first cover 210. The discharge holes 216*a* and 216*b* may include a first discharge hole 216*a* defined in the second part 212. A plurality of the first discharge hole 216*a* may be provided, and the plurality of first discharge holes 216*a* may be disposed or provided to be spaced apart from each other along a circumference of the second part 212.

As the discharge valve 161 is opened, the refrigerant, which does not pass through the spring assembly 163, of the refrigerant flowing into the first space part 210*a*, that is, the refrigerant existing in an upstream side of the spring assembly 163 may be discharged to the outside of the first cover 210 through the first discharge hole 216*a*. Also, the refrigerant discharged through the first discharge hole 216*a* may be introduced into the second space part 230*a* of the second cover 230.

The discharge holes 216*a* and 216*b* may include a second discharge hole 218*b* defined in the fourth part 214. A plurality of the second discharge hole 216*b* may be provided, and the plurality of second discharge holes 216*b* may be disposed or provided to be spaced apart from each other along a circumference of the fourth part 214.

As the discharge valve 161 is opened, the refrigerant, which passes through the spring assembly 163, of the refrigerant flowing into the first space part 210*a*, that is the refrigerant existing in or at a downstream side of the spring assembly 163 may be discharged to the outside of the first cover 210 through the second discharge hole 216*b*. Also, the refrigerant discharged through the second discharge hole 216*b* may be introduced into the second space part 230*a* of the second cover 230.

A number of second discharge holes 216*b* may be less than a number of first discharge holes 216*a*. Thus, in the refrigerant passing through discharge valve 161, a relatively large amount of refrigerant may pass through the first discharge holes 216*a*, and a relatively mall amount of refrigerant may pass through the second discharge holes 216*b*.

Also, the discharge cover 200 may define a discharge cover coupling hole 219*a*, through which a coupling member 219*b* that couples the discharge cover 200 to the frame 110 may pass. Three discharge cover coupling holes 219*a* may be provided at equal intervals along an outer circumference of the discharge cover 200. That is, the three coupling members 219*b* may be respectively formed at positions rotated at 120° with respect to a center of the discharge cover 200. Therefore, the discharge cover 200 may be stably coupled to the frame 110.

A cover flange 219 may be formed to protrude from one side of the discharge cover 200, and one of the discharge cover coupling holes 219*a* may be defined in the cover flange 219. The cover flange 219 may be disposed or provided such that one of the three discharge cover coupling holes 219*a* defined at equal intervals in the discharge cover 200 having an asymmetrical shape may be defined, and the cover flange 210 may extend by a certain length.

A cover recess part or recess 211*a* recessed inward may be defined on or at one side of the cover flange 219. The cover recess part 211*a* may be defined at a position corresponding to a terminal insertion part or portion 119*c*, which will be described hereinafter, and may be recessed to have a shape corresponding to at east a portion of an outer circumference of the terminal insertion part 119*c*. Therefore, the terminal insertion part 119*c* may be exposed through the cover recess part 211*a* in a state in which the discharge cover 200 is coupled to the front surface of the frame 110, so that a terminal coupled to a wire may pass through the cover recess part 211*a* and the terminal insertion part 119*c*.

A second gasket 280 may be provided between the discharge cover 200 and the frame 110. The second gasket 280 may contact each of a rear surface of the discharge cover 200 and, the front surface of the frame 110 to prevent vibration of the discharge cover 200 from being transferred to the frame 110. That is, as the second gasket 280 may be disposed or provided on a vibration transfer path from the discharge cover 200 inevitably generating vibration to the frame 110, it is possible to prevent transfer of vibration and thus prevent noise generation caused by the transfer of the vibration.

The second gasket 280 may be formed to have a sheet shape having a certain thickness and may be made of an asbestos-free material. For example, the gasket may be made of one of MP-15, CMP4000, or NI-2085, which are brand names.

The second gasket 280 may be formed to have a ring shape having a certain width s a whole. The width of the second gasket 280 may be less than a distance between an outer circumference of the rear surface of the discharge cover 200 and an opening defining the compression space of the center of the frame 110. That is, the second gasket 280 may be formed along a circumference of the compression space in a state of being seated on the front surface of the frame 110, and may contact the circumference of the rear surface of the discharge cover 200.

The second gasket 280 may define three gasket holes 281. The gasket holes 281 may be defined at positions corresponding to the discharge cover coupling holes 219*a* and may be penetrated when the coupling members 219*b* are coupled. That is, three gasket holes 281 may be respectively defined at positions rotated 120° with respect to the center of the gasket. Therefore, the second gasket 280 may be stably mounted between the discharge cover 200 and the frame 110.

Also, a recess part or recess 282 may be formed on or at one or a first side of the circumference of the second gasket 280 in a shape corresponding to a shape of the discharge cover 200 on a side of the cover flange 219 Therefore, the second gasket 280 on or at one or a first side of the cover flange 219 may be formed along the outer or a second side of the discharge cover 200 to prevent vibration transfer in an entire section between the discharge cover 200 and the frame 110.

Also, a gasket recess part or recess 283 may be formed at a position corresponding to the terminal insertion part 119*c* in the circumference of the second gasket 280. The gasket recess part 283 may be recessed from the inside to the outside of the second gasket 280 and may be formed to have a shape corresponding to a shape of the cover recess part 211*a*.

A gasket coupling part or portion 284 may be formed at an outer end of the gasket recess part 283. The gasket coupling part 284 may be formed to have a shape coupling a cutout portion of the second gasket 280 by the gasket recess part 283 and may be exposed to the outside of the cover recess part 211*a*. Due to the gasket coupling part 284, the gasket recess part 283 may be formed in the second gasket 280 and the second gasket 280 may maintain the whole shape.

The frame 110 may include a frame body 111 that extends in the axial direction, and a frame flange 112 that extends outward from the frame body 111 in the radial direction. The frame body 111 may have a cylindrical shape with a central axis or central longitudinal axis in the axial direction and have a space for accommodating the cylinder therein.

A second installation groove (see reference numeral 116*b* of FIG. 11) in which a first sealing member or seal 127 may be installed or provided may be defined in the frame flange 112. The first sealing member 127 may provide an airtight seal between the frame 110 and the second gasket 280 or the discharge cover 200, thereby preventing leakage of the refrigerant.

The frame flange 112 may further include coupling holes 119*a* and 119*b* that couple the frame 110 the discharge cover coupling member 219*b*, and the cover coupling member 149*a*. The coupling holes 119*a* and 119*b* may include a first coupling hole 119*a* to which the cover coupling member 149*a* that couples the frame 110 to the rear cover 170 may be coupled. Three first coupling holes 119*a* may be defined at corresponding positions such that the three cover coupling members 149*a* may be respectively coupled thereto. The first coupling holes 119*a* may be disposed or provided at positions rotated by the same angle, that is, 120°, with respect to the center of the linear compressor 10 in the axial direction. That is, the first coupling holes 119*a* may be disposed or provided at equal intervals along a circumference of the frame flange 112.

The coupling holes 119*a* and 119*b* may further include a second coupling hole 119*b* to which a discharge cover coupling member 219*b* that couples the discharge cover 200 to the frame 110 may be coupled. Three second coupling holes 119*b* may be defined at corresponding positions such that the three discharge cover coupling members 219*b* may be respectively coupled thereto. The second coupling holes 119*b* may be disposed or provided at positions rotated by the same angle, that is, 120 degree, with respect to the center of the linear compressor in the axial direction. That is, the second coupling holes 119*b* may be disposed or provided at equal intervals along the circumference of the frame flange 112.

The frame flange 112 may include a terminal insertion part or portion 119*c* that provides a withdrawing path of a terminal part 141*d* of the motor assembly 140. The terminal part 141*d* may extend forward from the coil 141*c* and be inserted into the terminal insertion part 119*c*. Due to such a structure, the terminal part 141*d* may extend from the motor assembly 140 and the frame 110, pass through the terminal insertion part 119*c*, and then connect to a cable which is directed to the terminal 108.

Three terminal insertion parts 119*c* may be provided and may be disposed or provided at equal intervals along a front surface of the frame flange 111. The terminal part 141*d* may be inserted into one of the three terminal insertion parts 119*c*. The remaining terminal insertion parts 119*c* may be formed for deformation prevention of the frame 110 and the balance of weight.

The terminal insertion parts 119*c* may be disposed or provided at positions rotated by the same angle, that is, 120°, with respect to the center of the linear compressor 10 in the axial direction, considering the whole balance in the frame flange 112 and a relationship between the first coupling hole 119*a* and the second coupling hole 119*b*.

Therefore, the three first coupling holes 119*a*, the three second coupling holes 119*b*, and the three terminal insertion parts 119*c* may be defined along an outer circumference of the frame flange 112. As these are defined at equal intervals in a circumferential direction with respect to a central portion in the axial direction of the frame 110, the frame 110 may be supported at three points of peripheral parts or components, that is, the discharge cover 200, and thus stably, coupled.

Figure 9:
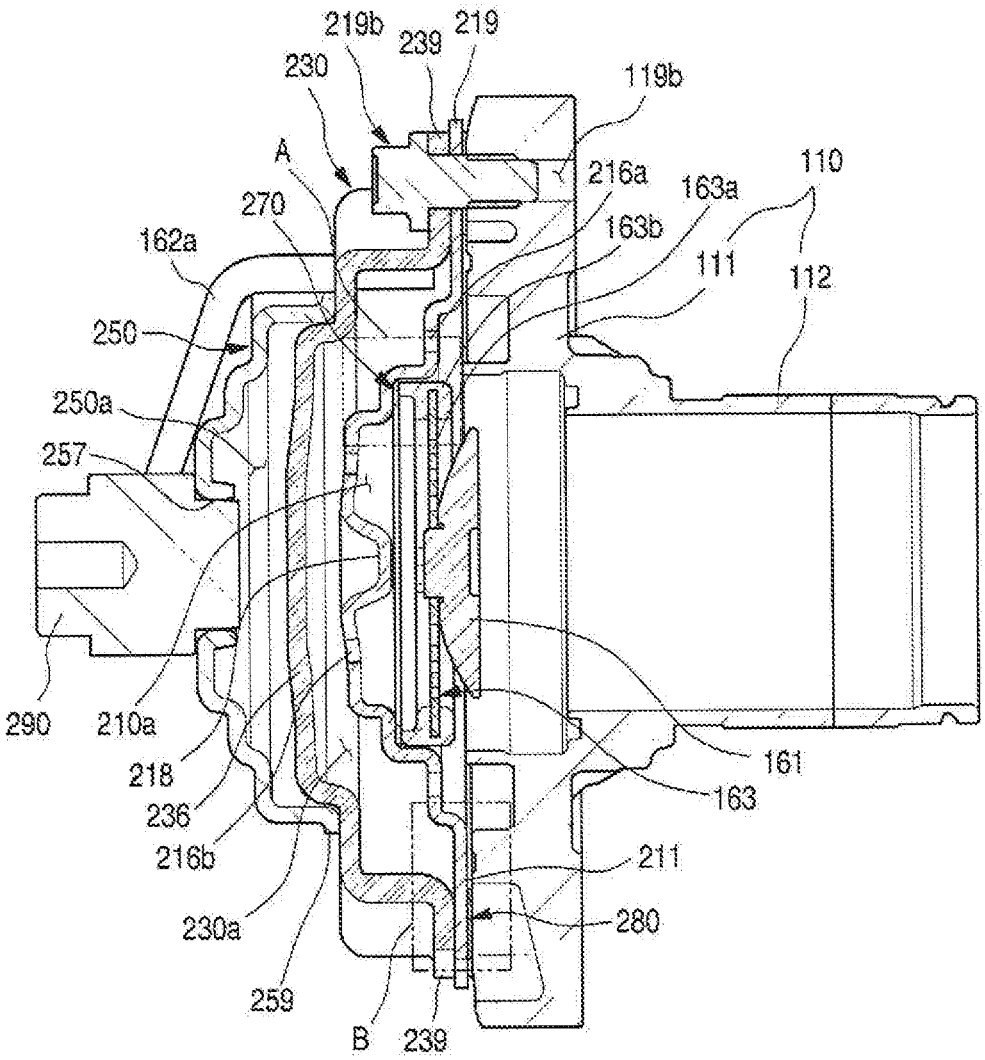
FIG. 9 is a cross-sectional view of a state in which a frame and a discharge cover are coupled to each other according to an embodiment.
Figure 10:
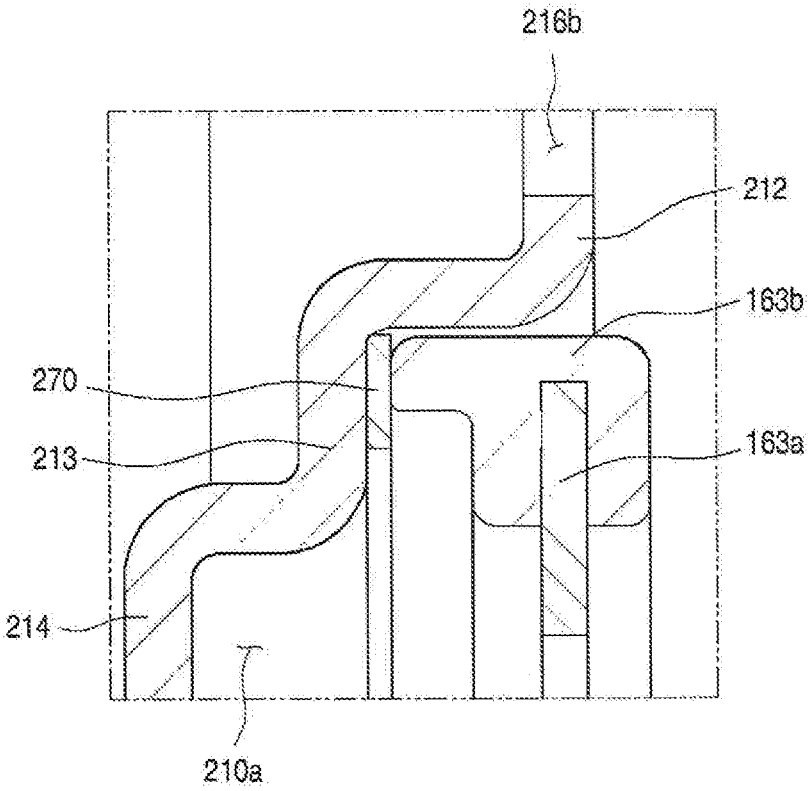
FIG. 10 is an enlarged view illustrating a portion A of FIG. 9.
Figure 11:
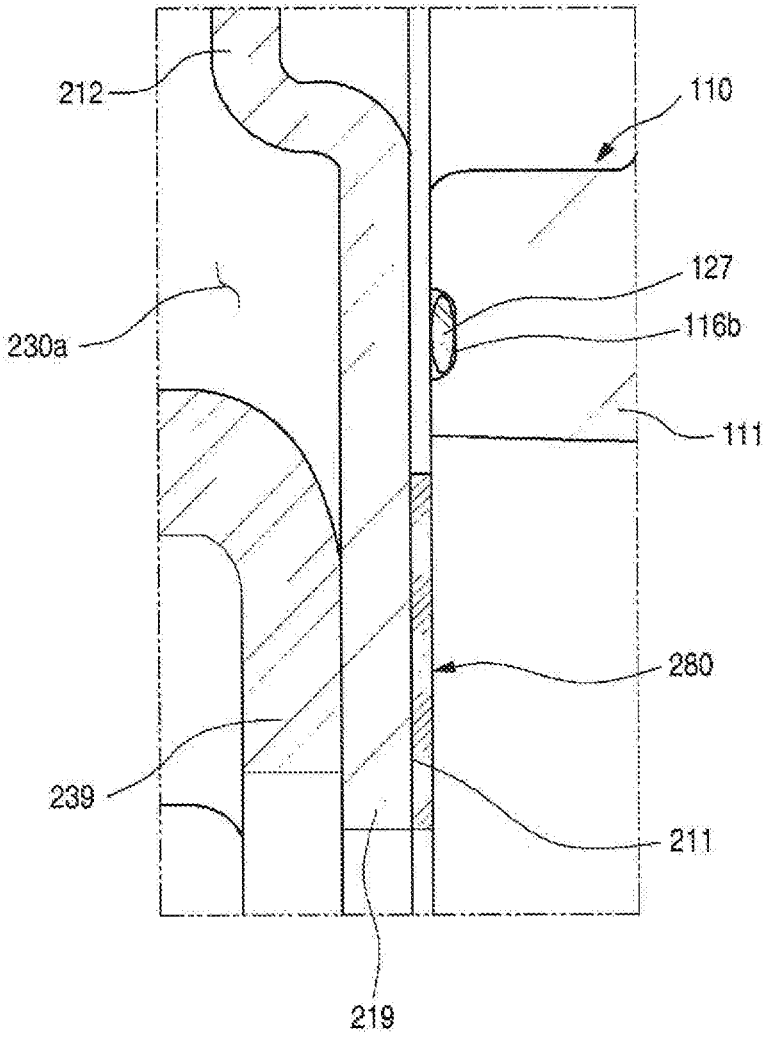
FIG. 11 is an enlarged view illustrating a portion B of FIG. 9.

FIG. 9 is a cross-sectional view illustrating a state in which a frame and a discharge cover are coupled to each other according to an embodiment. FIG. 10 is an enlarged view illustrating a portion A of FIG. 9. FIG. 11 is an enlarged view illustrating a portion B of FIG. 9.

Referring to FIGS. 9 and 11, discharge cover 200 according to an embodiment may include a plurality of covers 210, 230, and 250 that defines a plurality of discharge spaces or a plurality of discharge rooms. The plurality of covers 210, 230, and 250 may be coupled to the frame 110 and stacked forward with respect to the frame 110.

The plurality of covers 210, 230, and 250 may further include first cover 210 having first part 211 coupled to a front surface of the frame 110, and second cover 230 coupled to a front side of the first cover 210. The first and second covers 210 and 230 may be stacked in the axial direction. The discharge cover 200 may further include third cover 250 coupled to a front side of the second cover 230. The second and third covers 230 and 250 may be stacked in the axial direction. Consequently, the first to third covers 210, 230, and 250 may be stacked in the axial direction.

As described above, the first cover 210 may form a stepped structure. Also, first space part 210*a* where a refrigerant discharged through the discharge valve 161 may flow may be defined in the first cover 210.

The second cover 230 may be coupled to an outer surface of the first cover 210. As described above, due to the coupling of the first and second cover flanges 219 and 239, the first and second covers 210 and 230 may be coupled to each other. Also, second space part 230*a* where a refrigerant may flow may be defined between an outer surface of the first cover 210 and an inner surface of the second cover 230. The refrigerant discharged from the first cover 210 through the first and second discharge holes 216*a* and 216*b* of the first cover 210 may be introduced into the second space part 230*a*.

A volume ratio of the first to third space parts 210*a*, 230*a*, and 250*a* may be determined to be a preset or predetermined ratio. A volume of the second space part 230*a* may be larger than a volume of the first space part 210*a*, and a volume of the third space part 250*a* may be larger than the volume of the second space part 230*a*. Due to such a structure, the refrigerant may flow from the first space part 210*a* to the second space part 230*a* having a relatively large volume, thereby reducing pulsation and noise. Also, the refrigerant may flow from the second space part 230*a* to the third space part 250*a* having a relatively small volume, thereby securing a flow velocity of the refrigerant.

The discharge cover 200 may further include a connection pipe 260 through which the refrigerant of the second space part 230*a* may be transferred to the third space part 250*a* of the third cover 250. The connection pipe 260 may be coupled to the second cover 230 and extend outward from the second cover 230, and may be bent once or more times and coupled to the third cover 250.

Due to the connection pipe 260 extending outward from the second cover 230 and coupled to the outer surface of the third cover 250, a discharge passage of the refrigerant may be lengthened to reduce pulsation of the refrigerant. The refrigerant flowing through the cover pipe 162*a* may flow through the loop pipe 162*b* and be then discharged to the outside of the linear compressor 10 through the discharge pipe 105 coupled to the loop pipe 162*b*.

The spring assembly 163, to which the first gasket 270 and the discharge valve 161 may be coupled, may be seated in the first space part 210*a* inside of the discharge cover 200. At this time, the first gasket 270 may be seated on a bent seating surface of the third part 213. As the first gasket 270 is formed to have an internal diameter greater than an internal diameter of the third part 213 in a state of being seated on the third part 213, the first gasket 270 may support the spring support part 163*b* without disturbing the flow of the refrigerant passing through the first space part 210*a*. Therefore, at a time of driving the linear compressor 10, the first gasket 270 may support the spring assembly 163 and dampen vibration of the spring assembly 163 even when the discharge valve 161 is repeatedly opened and closed, thereby minimizing transfer of vibration of the spring assembly 163 along the discharge cover 200.

The second gasket 280 may be disposed or provided between the rear surface of the discharge cover 200 and a front surface of the frame flange 111. The second gasket 280 may completely insulate between the discharge cover 200 and the front surface of the frame 110. The second gasket 280 may be seated along the circumference of the frame flange 111 and positioned in an inner region of the discharge cover 200, such that the second gasket 280 is not exposed to the outside of the discharge cover 200, except for the cover recess part 211*a*.

The coupling member 219*b* may pass through the discharge cover coupling hole 219*a* and the gasket hole 281, such that the coupling member 219*b* may be coupled to the second coupling hole 119*b* on the frame 110. Due to such a coupling structure, the frame 110 and the discharge cover 200 may be coupled to each other in a state in which the discharge cover 200 is positioned on the front surface of the frame 110. The second gasket 280 may be coupled and fixed together when the discharge cover 200 and the frame 110 are coupled to each other.

Figure 12:
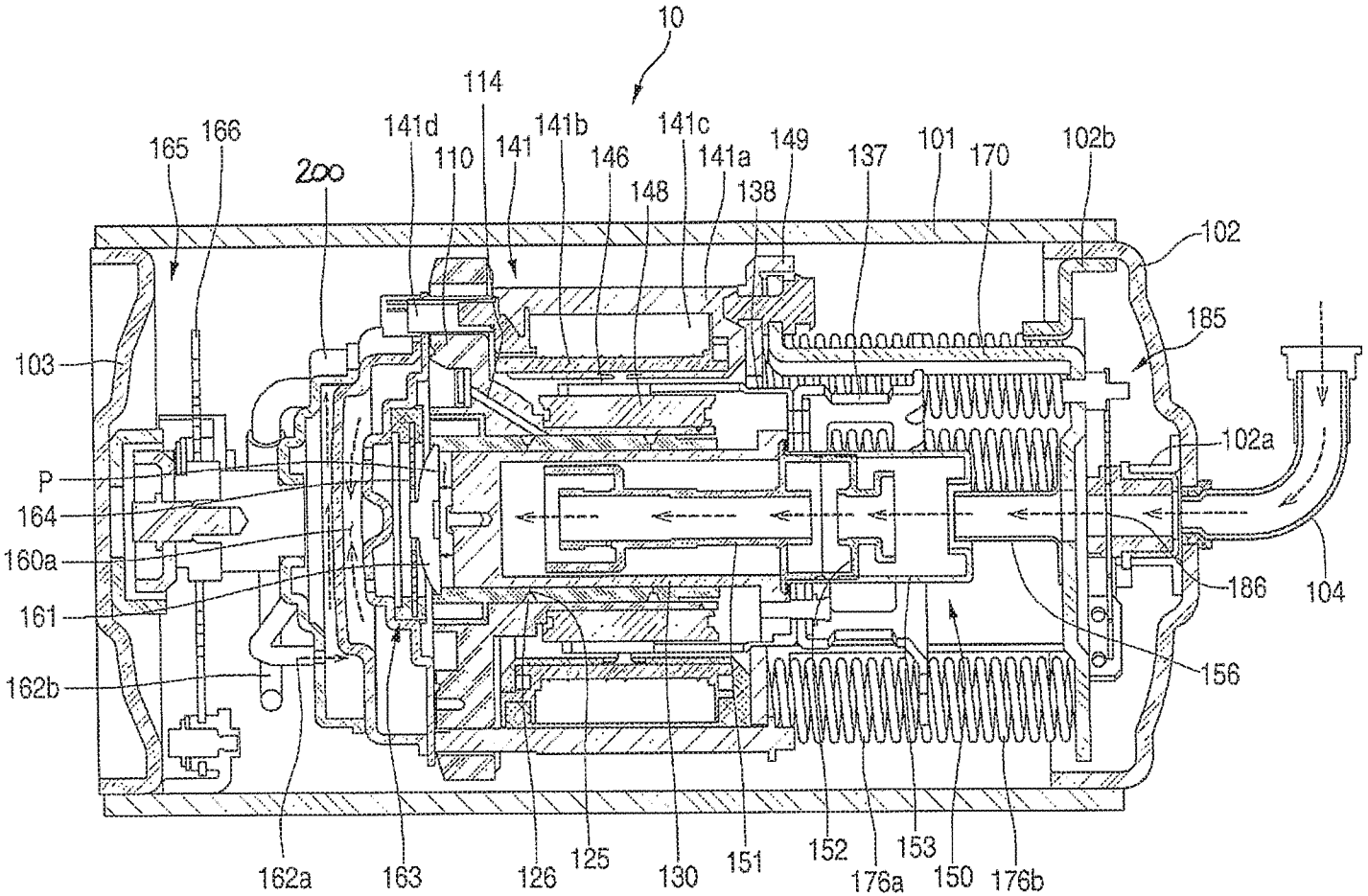
FIG. 12 is a cross-sectional view illustrating a state in which a refrigerant flows in the linear compressor according to an embodiment.

FIG. 12 is a cross-sectional view illustrating a state in which a refrigerant flows in the linear compressor according to an embodiment. The flow of the refrigerant in the linear compressor 10 according to an embodiment will be described with reference to FIG. 12. The refrigerant suctioned into the shell 101 through the suction pipe 104 may flow into the piston 130 via the suction muffler 150. When the motor assembly 140 is driven, the piston 130 may reciprocate in the axial direction.

When the suction valve 135 coupled to the front side of the piston 130 is opened, the refrigerant may be introduced and compressed in the compression space P. When the discharge valve 161 is opened, the compressed refrigerant may be introduced into the discharge space of the discharge cover 200.

The refrigerant introduced into the discharge space may flow from the first space part 210*a* to the second space part 230*a* in the discharge cover 200, and the refrigerant of the second space part 230*a* may be introduced into the third space part 250*a* through the connection pipe 260. Also the refrigerant of the third space part 250*a* may be discharged from the discharge cover 200 through the loop pipe 162*b* and discharged to the outside of the linear compressor 10 through the discharge pipe 105.

In the process of repeatedly opening and closing the discharge valve 161 so as to discharge the refrigerant, the spring assembly 163 may be repeatedly elastically deformed, and vibration generated during this process may be blocked by the first gasket 270. Therefore, it is possible to minimize transfer of vibration to the discharge cover 200 during the opening and closing of the discharge valve 161.

Also, the second gasket 280 provided between the discharge cover 200 and the frame 110 may minimize the transfer of the vibration between the discharge cover 200 and the frame 110. Therefore, even when a portion of the vibration is transferred to the discharge cover 200 during the opening and closing of the discharge valve 161, the second gasket 280 may prevent the vibration from being transferred to, the frame 110. Thus, it is possible to prevent noise from occurring due to the transfer of the vibration to the frame 10 and other components coupled to the frame 110.

A process of assembling a compressor according to an embodiment sill be described hereinafter with reference to the accompanying drawings.

First, in order to assemble the compressor 10, the shell 101 may be molded in a cylindrical shape. During the molding of the shell 101, the spring coupling part 101*a* may be mounted on the inside of the shell 101. The support leg 50 may be mounted on the outside of the shell 101.

The first shell cover 102 and the second shell cover 103 may be molded by forming, so as to be mounted on both opened sides of the shell 101. The first shell cover 102 and the second shell cover 103 may be formed to have a shape corresponding to both opened sides of the shell 101 and the circumferences thereof may be bent to come into surface contact with the shell 101. Thus, the first shell cover 102 and the second shell cover 103 may have a weldable structure.

In such a state, the compressor body may be assembled. The discharge cover 200, the piston 120, the cylinder 130, the frame 110, the muffler 150, the motor assembly 140, the support 137, the resonant springs 176*a* and 176*b*, the rear cover 170, and the second support device 185, which constitute or form the compressor body, may be sequentially coupled to one another to complete assembling in one module state. Other components which are not described above, may also be assembled together during the assembling of the compressor body.

When the suction pipe 104 is coupled to the first shell cover 102, the stopper 102*b* may be mounted on the inner surface of the first shell cover 102. The cover support part 102*a* may be mounted on the inner center of the first shell cover 102. In such a state, the compressor body may be mounted on the inner surface of the first shell cover 102. At this time, the central portion of the second support device 185 may be inserted into the cover support part 102*a*. The compressor body and the first shell cover 102 may be temporarily fixed by a separate jig.

In such a state, the compressor body may be inserted into the molded shell 101. That is, the compressor body may be accommodated in the shell 101 by moving the shell 101 downward in a state in which the shell 101 is disposed above the compressor body in which the first shell cover 102 is mounted. The circumference of the first shell cover 102 may contact the inner surface of the shell 101, and in such a state, the first shell cover 102 may be coupled to the shell 101 by welding, for example.

Then, the first support device 165 may be disposed through one opened surface of the shell 101. At this time, the first support device 165 may be coupled to an upper end of the discharge cover 200 and seated on the discharge cover 200, and the discharge cover 200 may absorb vibration of the compressor body.

The first support device 165 may be seated to be supported to the spring coupling part 101*a* inside of the shell, and the first support device 165 may be fixed on the shell 101 by the spring coupling member 630. Therefore, due to the mounting of the first support device 165, the compressor body may be fixed to the inside of the shell 101.

When the mounting of the first support device 165 is completed, the molded second shell cover 103 may be seated to close the opening of the shell 101. The circumference of the second shell cover 103 may be bent, and the second shell cover 103 and the shell 101 may come into surface contact with each other. In such a state, the second shell cover 103 and the shell 101 may be fixed to each other by welding, for example. The terminal 108 outside of the compressor 10 may be coupled to the discharge pipe 105 and the process pipe 106, thereby completing the entire assembling of the compressor 10.

Figure 13:
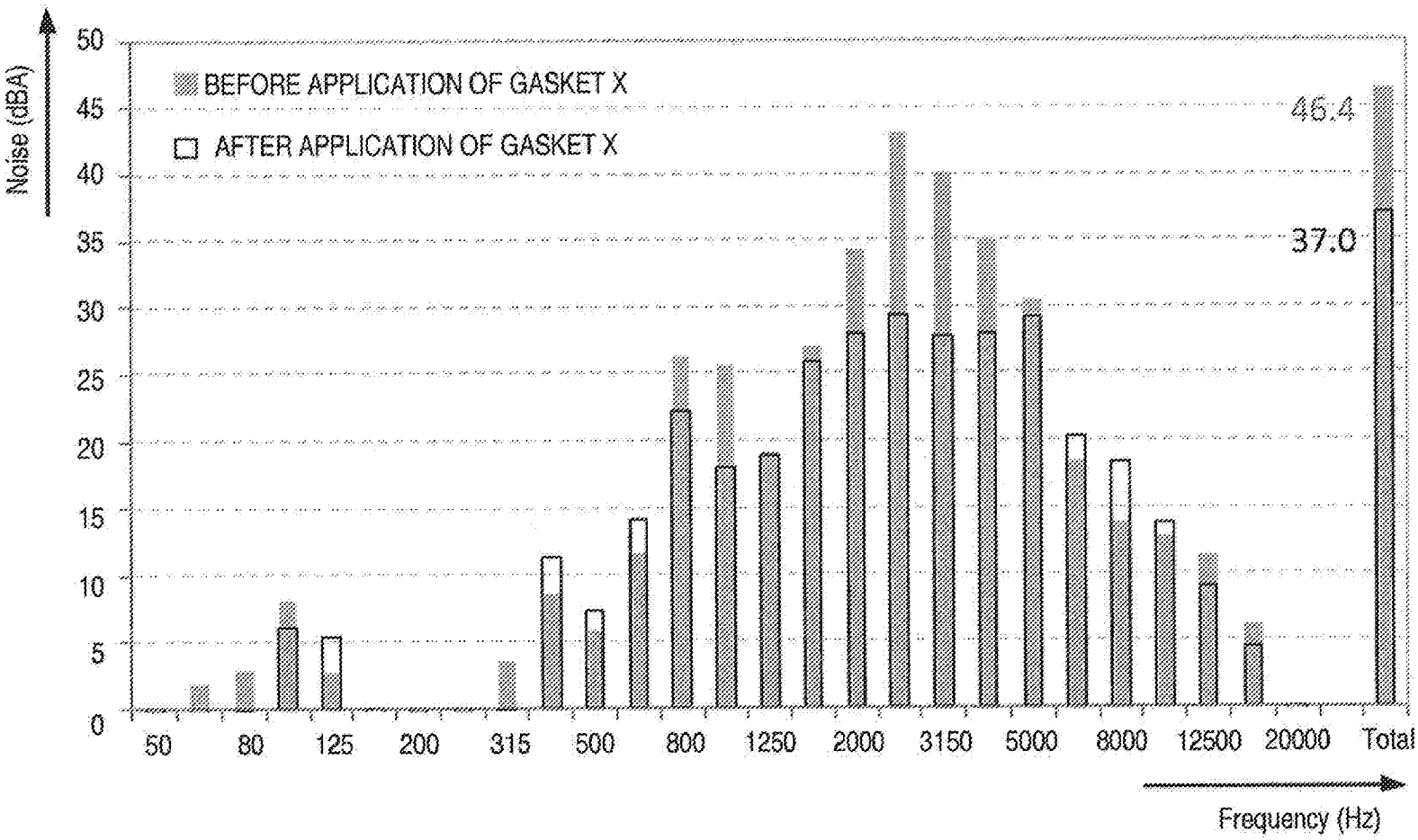
FIG. 13 is a graph showing an axial noise measurement result of the linear compressor according to an embodiment.
Figure 14:
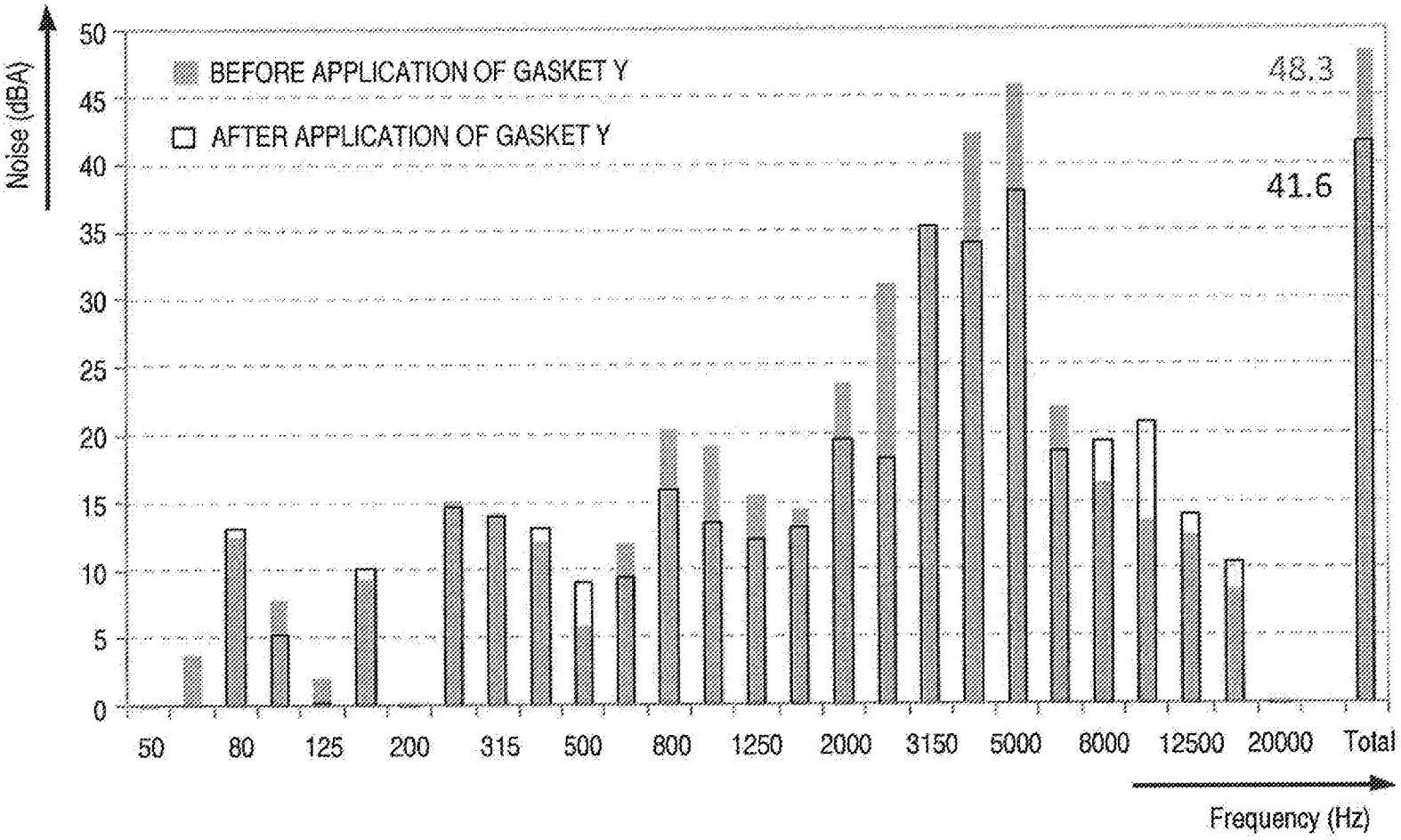
FIG. 14 is a graph showing a radial noise measurement result of the linear compressor according to an embodiment.

FIG. 13 is a graph showing an axial noise measurement result of the linear compressor according to an embodiment. FIG. 14 is a graph showing a radial noise measurement result of the linear compressor according to an embodiment.

FIGS. 13 and 14 illustrate comparison between noise during driving of the compressor when the first gasket and the second gasket are applied and noise during the driving of the compressor when the first gasket and the second gasket are applied.

Regarding the noise in the axial direction (X direction) as shown in FIG. 13, when the compressor 10 is driven and in a section in which a frequency is about 800 Hz to about 5,000 Hz, that is, in a main operation section of the compressor 10, the noise was remarkably reduced as compared with the compressor 10 to which the gaskets 270 and 280 are not applied.

As a whole, the noise during the driving of the compressor 10 including the gaskets 270 and 280 corresponds to about 37.0 dBA, and the noise during the driving of the compressor 10 not including the gaskets 270 and 280 corresponds to about 46.4 dBA.

Therefore, as shown in the graph, the structure to which the gaskets 270 and 280 are applied may expect noise reduction of about 20%. In particular, due to the structure of the cylindrical shell 101, a magnitude of axial vibration and noise increases when the vibration and noise are generated. Thus, application of the gaskets 270 and 280 may result in a significant noise reduction effect.

Regarding the noise in the radial direction (Y direction) as shown in FIG. 14, when the compressor 10 is driven and in the section in which the frequency is about 800 Hz to about 5,000 Hz, that is, in the main operation section of the compressor 10, the noise was remarkably reduced as compared with the compressor to which the gaskets 270 and 280 are not applied.

As a whole, the noise during the driving of the compressor 10 including the gaskets 270 and 280 corresponds to about 41.6 dBA, and the noise during the driving of the compressor 10 not including the gaskets 270 and 280 corresponds to about 48.3 dBA. Therefore, as shown in the graph the structure to which the gaskets 270 and 280 are applied may expect noise reduction of about 15%.

As shown in FIGS. 13 and 14, both the axial noise and the radial noise may be reduced by the application of the gaskets 270 and 280. In particular, the axial noise having a great influence on the vibration noise due to the shape of the shell 101 may be remarkably reduced, thereby improving a whole noise reduction performance.

The linear compressors according to embodiments have at leas the following advantages.

According to embodiments disclosed herein, the first gasket may be provided between the discharge cover and the spring assembly in which the discharge valve is mounted. Therefore the first gasket may support the spring assembly, attenuate vibration generated when the discharge valve is opened or closed, and minimize vibration transfer to the discharge cover. Consequently, noise generated by vibration of the discharge cover may be reduced.

Also, the second gasket may be provided between the discharge cover and the frame. The vibration generated in the discharge cover may be blocked by the second gasket, and vibration transfer to the frame may be minimized. Therefore, vibration of the frame and components coupled to the frame may be minimized to remarkably reduce a whole noise of the compressor.

Each of the first gasket and they spring assembly may define the first protrusion and the second protrusion, and, the recess part may be formed inside of the discharge cover to accommodate the first protrusion and the second protrusion. Thus, the first gasket and the spring assembly may maintain a fixed state without rotating, thereby preventing noise and damage.

Also coupling between the discharge cover and the frame and fixing between the discharge cover and the frame may be achieved at once just by the coupling of the coupling member for coupling the discharge cover. Thus, assemblability and productivity of the linear compressor may be improved.

Also, the second gasket may define the gasket recess part, and the discharge cover may define the cover recess part. Thus, entrance and exit of the terminal part may be possible. At the same time, even in a state in which the gasket recess part is molded in the gasket, a shape of the second gasket may be maintained by the gasket coupling part, thereby preventing incorrect assembling and performance degradation.

Embodiments disclosed herein provide a linear compressor in which a gasket for reducing vibration caused by a discharge valve may be provided to thereby reduce noise when the compressor is driven. Embodiments disclosed herein also provide a linear compressor in which a gasket may be provided between a discharge cover and a valve spring that supports a discharge valve, thereby attenuating vibration caused by operation of the discharge valve, and thus, reducing noise. Embodiments disclosed herein further provide a linear compressor in which a gasket may be provided between a discharge cover and a coupling surface of a frame, thereby attenuating vibration caused by operation of the discharge valve, and thus, reducing noise.

Embodiments disclosed herein provide a linear compressor that may include a cylinder which defines a compression space for a refrigerant and into which a piston reciprocating, in an axial direction may be inserted; a frame into which the cylinder may be accommodated; a discharge valve that selectively discharges the refrigerant compressed in the compression space for the refrigerant; a spring assembly coupled to the discharge valve; a discharge cover on which the spring assembly may be seated and which has a discharge space through which the refrigerant discharged through the discharge valve may flow; and a first gasket seated inside of the discharge cover to support, the spring assembly and attenuate vibration during an operation of the discharge valve. The discharge cover may define a seating surface which is stepped inward and on which the first gasket may be seated.

The spring assembly may include a valve spring which has a plate spring shape and to which the discharge valve may be coupled in a center thereof, and a spring support part or portion disposed or provided along a circumference of the valve spring and made of a plastic material. The spring support part may be insert injection-molded with the valve spring. The first gasket may have a same circumferential shape as that of the spring support part.

A plurality of first protrusions may be formed to protrude outward at equal intervals along a circumference of the spring support part. A plurality of recess parts or recesses may be formed inside of the discharge cover in a shape to accommodate the plurality of first protrusions. The plurality of first protrusions and the plurality of recess parts may be disposed or provided at positions rotated by each 120° with respect to a central portion of the spring assembly and the discharge cover.

A second protrusion may be formed to protrude in a same shape as the first protrusion at a position corresponding to the first protrusion along a circumference of the first gasket. The second protrusion may be accommodated inside of the recess part together with the first protrusion. A second gasket may be provided between a circumference of the discharge cover and the frame to prevent vibration of the discharge cover from being transferred to the frame.

The discharge cover may include a plurality of coupling members that passes through the discharge cover and the second gasket and coupled to the frame. The discharge cover may be coupled to the frame by the plurality of coupling members.

The discharge cover, the second gasket, and the frame may define a plurality of coupling holes through which the coupling members may pass. The plurality of coupling holes may be disposed or provided at positions rotated by each 120° with respect to a center of the discharge cover.

A cover flange that protrudes outward may be formed on or at one side of the discharge cover. One of the coupling holes may be defined on the cover flange.

The frame may define a terminal insertion part or portion opened such that a terminal part or portion coupled to a power line may pass therethrough. The discharge cover may define a cover recess part or recess at a position corresponding to the terminal insertion part so as to allow the terminal part to enter or exit from the cover recess part through the discharge cover.

A gasket recess part or recess may be recessed outward from one inner circumference of the second gasket at a position corresponding to the cover recess part and the terminal insertion part. The terminal part may pass through the gasket recess part.

The second gasket may further include a gasket coupling part or portion coupled to the gasket recess part to form a portion of a circumference of the second gasket. The second gasket may define a gasket coupling part or portion exposed to the outside of the discharge cover through the outside of the cover recess part and crossing an opened end of the cover recess part.

The second gasket may define a recess part or recess having a shape corresponding to a recessed shape of the discharge cover outside of the cover flange. A sealing member or seal may be provided at an end of the frame to seal between the frame and the discharge cover, and the second gasket may be disposed or provided to be outer than the sealing member.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure or characteristic in connection with other ones of the embodiments.

Although embodiments have been described with reference to a number of illustrative embodiments thereof, it should be understood that numerous other modifications and embodiments can be devised by those skilled in the art that will fall within the spirit and, scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a cylinder which defines a compression space for a refrigerant and into which a piston that reciprocates in an axial direction is inserted;

a frame into which the cylinder is inserted to be accommodated therein, the frame including a frame body configured to surround the cylinder and a frame flange that extends from the frame body in a radial direction;

a motor assembly configured to surround the frame body at a rear of the frame flange in a direction of a flow of the refrigerant and including a terminal portion that guides a power line;

a discharge valve that selectively discharges the refrigerant compressed in the compression space for the refrigerant and disposed to be supported on a front surface of the cylinder in the direction of the flow of the refrigerant;

a spring assembly coupled to the discharge valve;

a discharge cover on which the spring assembly is seated, the discharge cover including a cover portion configured to define a discharge space through which the refrigerant discharged through the discharge valve flows and a cover flange that extends from the cover portion in the radial direction;

a first gasket seated inside of the cover portion of the discharge cover to support the spring assembly and attenuate vibration during an operation of the discharge valve; and a second gasket provided between the discharge cover and the frame, the second gasket having a ring shape and being arranged along a circumference of the compression space, wherein the frame flange includes a first surface in which at least one first coupling hole is formed and in which a terminal insertion portion is formed, and the cover flange includes a second surface facing the first surface and in which at least one second coupling hole is formed, wherein the second gasket is provided between the first surface and the second surface, the second gasket including at least one gasket hole, wherein at least one coupling member passes through the at least one second coupling hole and the at least one gasket hole and is coupled to the at least one first coupling hole, wherein a first surface of the second gasket contacts the second surface of the cover flange and a second surface of the second gasket contacts the first surface of the frame flange, wherein a cover recess is defined at a position corresponding to the terminal insertion portion at one side of the cover flange, the cover recess being recessed inward from a circumference of the cover flange, wherein the second gasket includes:

a gasket recess formed at a position corresponding to the terminal insertion portion and the cover recess in the axial direction, the gasket recess being recessed radially from an inner edge of the second gasket toward an outer edge of the second gasket, and a gasket coupling portion configured to form a portion of the outer edge of the second gasket and disposed outside the gasket recess in the radial direction, wherein the terminal portion passes through the cover recess, the gasket recess, and the terminal insertion portion, and wherein a sealing member is installed in a groove formed at the first surface of the frame flange and is disposed inside of the second gasket in the radial direction to provide an airtight seal between the frame flange and the second gasket or the discharge cover.

2. The linear compressor according to claim 1, wherein the cover portion of the discharge cover defines a seating surface which is stepped inward and on which the first gasket is seated.

3. The linear compressor according to claim 1, wherein the spring assembly includes:

a valve spring in the shape of a plate spring and to which the discharge valve is coupled at a center thereof; and a spring support provided along a circumference of the valve spring and made of a plastic material.

4. The linear compressor according to claim 3, wherein the spring support is insert-injection-molded with the valve spring.

5. The linear compressor according to claim 3, wherein the first gasket has a same circumferential shape as a circumferential shape of the spring support.

6. The linear compressor according to claim 3, wherein a plurality of first protrusions protrudes outward at equal intervals along a circumference of the spring support, and a plurality of recesses is formed inside of the discharge cover in a shape to accommodate the plurality of first protrusions.

7. The linear compressor according to claim 6, wherein the plurality of first protrusions and the plurality of recesses are provided at positions rotated by 120° with respect to a central portion of the spring assembly and the discharge cover.

8. The linear compressor according to claim 6, wherein a plurality of second protrusions protrudes in a same shape as the plurality of first protrusions at a position corresponding to the plurality of first protrusions along a circumference of the first gasket, and wherein the plurality of second protrusions is accommodated inside of the respective plurality of recesses together with the respective plurality of first protrusions.

9. The linear compressor according to claim 1, wherein the at least one coupling member includes a plurality of coupling members that passes through the discharge cover and the second gasket and is coupled to the frame, and wherein the discharge cover is coupled to the frame by the plurality of coupling members.

10. The linear compressor according to claim 9, wherein the at least one first coupling hole, the at least one second coupling hole, and the at least one gasket hole include a plurality of first coupling holes, a plurality of second coupling holes, and a plurality of gasket holes through which the plurality of coupling members passes, and wherein the plurality of first coupling holes, the plurality of second coupling holes, and the plurality of gasket holes are provided at positions rotated by 120° with respect to a center of the discharge cover.

11. The linear compressor according to claim 10, wherein the plurality of gasket holes is arranged in a circumferential direction.

12. The linear compressor according to claim 11, wherein the plurality of gasket holes includes three gasket holes.

13. The linear compressor according to claim 1, wherein the second gasket includes a recess having a shape corresponding to a recessed shape of the discharge cover outside of the cover flange, and wherein the recessed shape of the discharge cover is located on an opposite side of the cover recess with respect to the at least one second coupling hole.

14. The linear compressor according to claim 1, wherein the second gasket is seated on the second surface of the cover flange and contacts a circumference of the second surface of the cover flange.

15. The linear compressor according to claim 1, wherein the second gasket includes a sheet.

16. The linear compressor according to claim 1, wherein the second gasket is made of an asbestos-free material.

17. The linear compressor according to claim 1, wherein a width of the second gasket in the axial direction is less than a distance between an outer circumference of the second surface of the cover flange and an opening defining the compression space of the cylinder.

18. The linear compressor according to claim 1, further including a discharge pipe through which the refrigerant compressed in the compression space of the cylinder is discharged from the linear compressor via the discharge cover.

19. The linear compressor according to claim 18, further including:

a cover pipe coupled to the discharge cover through which the refrigerant flowing through the discharge space of the discharge cover flows; and a loop pipe coupled to the cover pipe through which the refrigerant flowing through the cover pipe is discharged to the discharge pipe, wherein a first side of the loop pipe is coupled to the cover pipe and a second side of the loop pipe is coupled to the discharge pipe.

20. The linear compressor according to claim 19, wherein the discharge cover includes at least one discharge hole through which the refrigerant flowing through the discharge space is discharged to the cover pipe.

21. The linear compressor according to claim 1, wherein the discharge cover includes a stopper provided in a central portion of the cover portion that protrudes backward toward the spring assembly, wherein when an opened degree of the discharge valve is greater than a predetermined level, the stopper protects the discharge valve or the spring assembly.

* * * * *